United States Patent [19]

Bell et al.

[11] 4,028,739

[45] June 14, 1977

[54] VENTILATED HELMET WITH SELECTED WEIGHT DISTRIBUTION

[75] Inventors: Richard L. Bell, Philadelphia; Matthew J. Lamb, Newtown, both of Pa.

[73] Assignee: The United States of America as represented by the Secretary of the Navy, Washington, D.C.

[22] Filed: July 2, 1976

[21] Appl. No.: 701,940

[52] U.S. Cl. ..... 2/6; 2/411

[51] Int. Cl.[2] ..... A42B 3/00

[58] Field of Search ..... 2/410, 411, 424, 425, 2/6

[56] References Cited

UNITED STATES PATENTS

| | | | |
|---|---|---|---|
| 3,110,034 | 11/1963 | Aileo | 2/6 |
| 3,315,272 | 4/1967 | Olt et al. | 2/424 |
| 3,495,273 | 2/1970 | Aileo | 2/6 |
| 3,748,657 | 7/1973 | Aileo | 2/6 |
| 3,833,935 | 9/1974 | Ansite et al. | 2/6 |

*Primary Examiner*—Alfred R. Guest

*Attorney, Agent, or Firm*—R. S. Sciascia; Henry Hansen

[57] ABSTRACT

An improved, lightweight helmet and visor assembly suitable for use in high performance aircraft during flight and ejection, if necessary, of the pilot. A plurality of holes are formed in the forward area of the crown region of the helmet shell beneath a visor guard and along the side edges of the visor guard to relocate the center of gravity of the helmet, reduce the aerodynamic pressure of windblast during ejection, increase stability during high acceleration, increase ventilation and cooling, and increase comfort to the pilot while maintaining the structural integrity of the helmet.

15 Claims, 4 Drawing Figures

VENTILATED HELMET WITH SELECTED WEIGHT DISTRIBUTION

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

The present invention relates to safety helmets and more particularly to safety helmets with visors used by pilots and crew in high performance aircraft.

Prior art safety helmets used by pilots and crew of high performance aircraft such as the F-4 or F-14 fighters have caused considerable discomfort during high head-to-seat acceleration such as in a pull-out from a dive because the greater concentration of weight in the helmet front tends to rotate the helmet forwardly against the face of the aircrewman. If ejection from the aircraft becomes necessary, the windblast against such helmets also resulted in severe discomfort or even injury. The dynamic air pressure inside the helmet shell as well as beneath the visor guard creates a lift force which is imparted to the pilot's head. Windblast frequently causes the helmet visor to fracture and be blown off of the helmet or forced into the pilot's face. Furthermore, prior art helmets are very uncomfortable due to lack of ventilation and cooling. One solution to that problem was the bulky and power consuming forced air cooling system. In other helmet designs, cloth hat suspensions provided cooling, but ventilation was limited to the periphery of the helmet shell.

SUMMARY OF THE INVENTION

Accordingly, it is a general purpose of the present invention to provide a safety helmet and visor assembly which is comfortable to the wearer under sustained usage, which remains fitted relative to the head during high head-to-seat acceleration, and which minimizes the dynamic pressure effect of windblast.

Another object of the present invention is to provide a helmet and visor assembly of reduced overall weight with the center of gravity moved rearward and downward for a more stable helmet.

A further object of the present invention is to provide a helmet and visor assembly which aerodynamically configured to withstand severe windblast present during pilot ejection from high performance aircraft.

Still another object of the present invention is to provide a helmet and visor assembly which remains fixed relative to the pilot's head during high head-to-seat acceleration.

Yet another object of the present invention is to provide a novel and improved helmet and visor assembly which is relatively simple and inexpensive to fabricate and assemble, comfortable to the wearer, and which provides optimum safety.

Briefly, these and other objects of the invention are accomplished by means of a protective helmet having material removed from forward areas thereof. The portion of the crown region of the helmet shell underneath the visor is provided with holes in order to remove material in this area while maintaining the structual integrity of the shell. Material is also removed from the visor tracks so as to form apertures therein. This removal of material in the frontal region of the helmet causes the center of gravity of the helmet to be moved rearward and downward, thus increasing helmet stability while reducing overall helmet weight. The effect of a "front/top heavy " helmet is also relieved thereby. The holes in the helmet shell and the apertures in the visor tracks which are thus formed permit air flow under the visor and into the helmet shell, thus promoting ventilation and cooling for the pilot's head and relieving dynamic air pressure under the visor and the helmet shell to prevent helmet fractures.

Other objects, advantages and novel features of the invention will become apparent from the following detailed description of the invention when considered in conjunction with the accompanying drawings wherein:

DESCRIPTION OF THE PREFERRED EMBODIMENT

Figure 1:
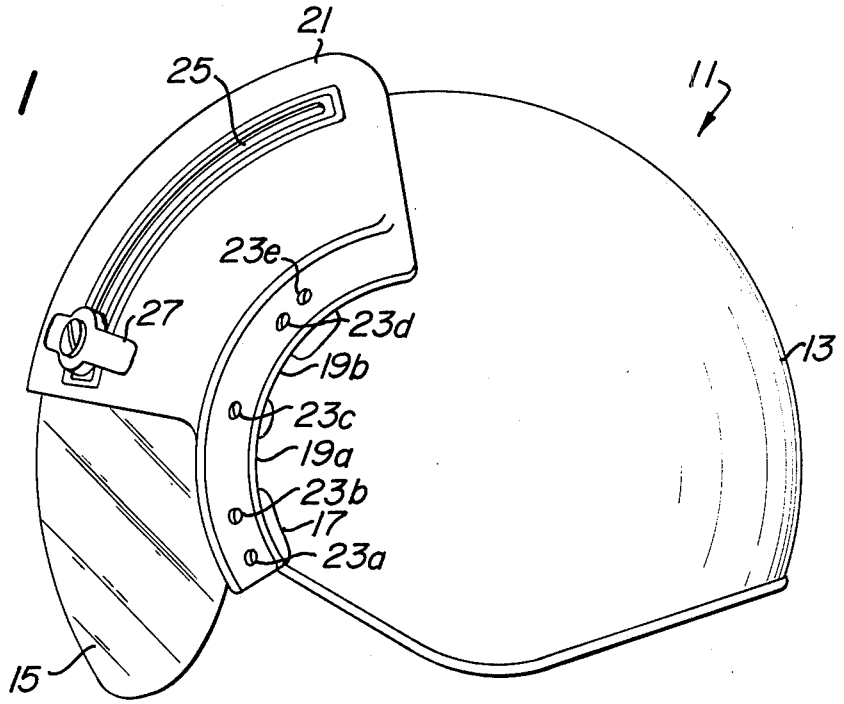
FIG. 1 is a side view of a helmet according to the invention.
Figure 2:
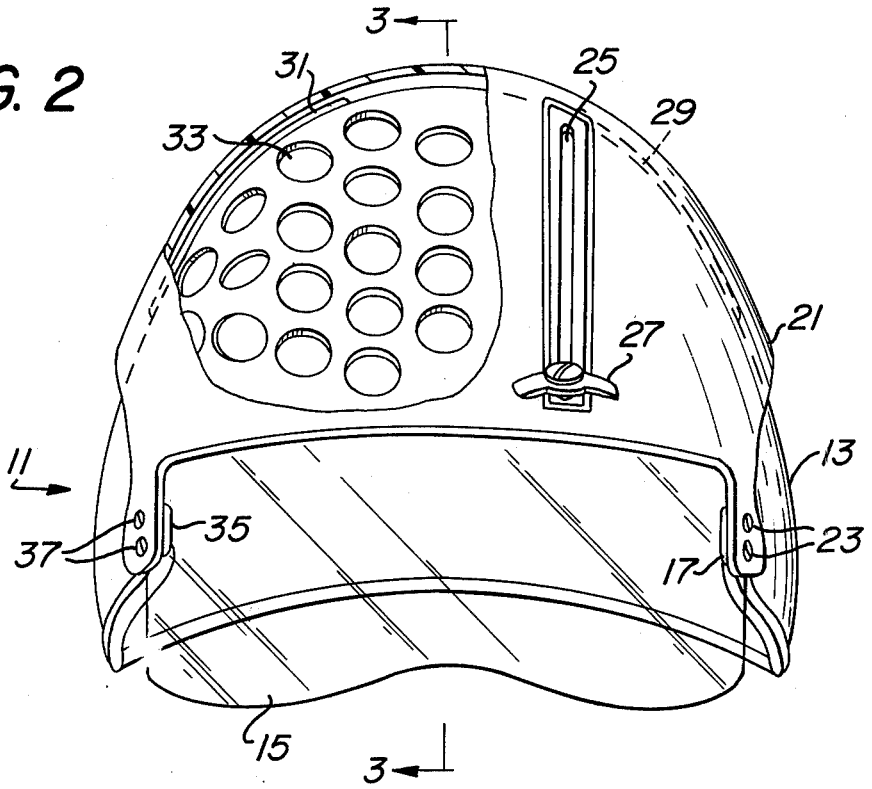
FIG. 2 is a front view of the helmet of FIG. 1 with a portion of the visor guard removed.
Figure 3:
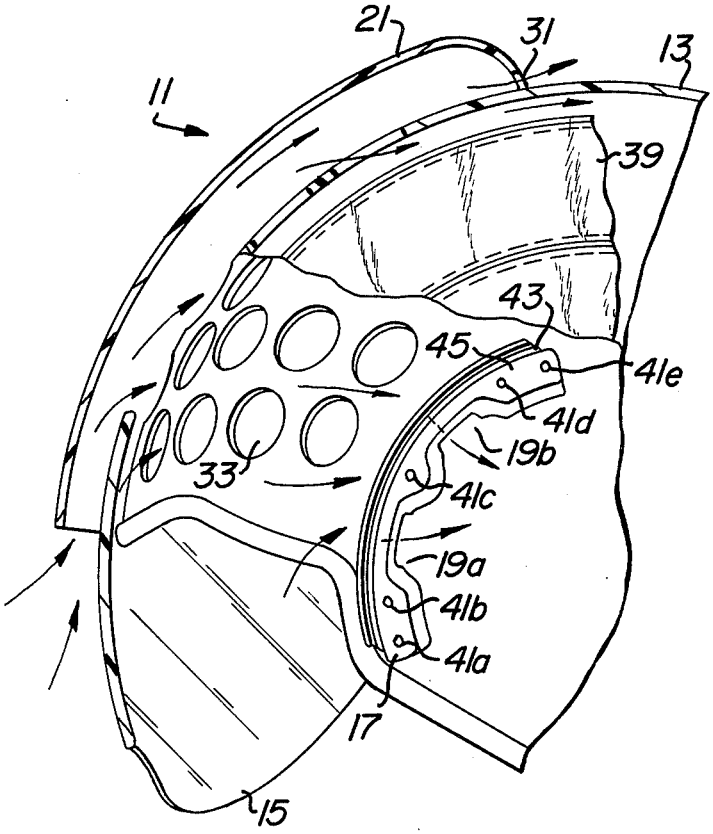
FIG. 3 is a section of the helmet taken along the line 3—3 of FIG. 2.

Referring now to the drawings, wherein like reference characters designate like or corresponding parts throughout the several views, there is shown in FIG. 1–3 (which illustrate a preferred embodiment) a helmet 11 having a helmet shell 13 which is rigid and is capable of resisting impact. Helmet 11 also has a visor 15 (shown extended), which can be clear or dark, and which is slidably mounted on visor tracks 17 and 35 and on visor guard 21, as is further discussed hereinbelow. Helmet shell 13 can be preferably constructed of a light weight, high strength material with impact and penetration protection, such as fiberglass. Visor guard 21 can be preferably constructed of a shatter-resistant, impact-resistant polymer. Visor tracks 17 and 35 can be preferably constructed of a nylon-type plastic, and visor 15 can be preferably constructed of a polycarbonate plastic with a scratch-resistant surface coating. Visor tracks 17 and 35 are mounted on shell 13. Visor guard 21 is supportably mounted on, and is spaced away from shell 13 by, visor tracks 17 and 35. Guard 21 and tracks 17 and 35 are held onto shell 13 by means of a plurality of fasteners 23 and 37, respectively, which can be screws, rivets, bolts with nuts, etc., or any combination thereof. Each fastener 23 or 37 can be used to hold together shell 13, track 17 or 35, and guard 21, although some fasteners can be used to only fasten a track to the shell or the guard to a track, for easier alignment of all of these pieces with respect to each other. For example, fasteners **23*a* and 23*e* can be rivets fastening guard 21 and track 17 together, and fasteners 23*b*, 23*c* and 23*d* can be screws or bolts fastening guard 21, track 17 and shell 13 together. Fastening guard 21 and track 17 together would make their subsequent initial alignment with shell 13 easier. A similar arrangement could be used for fastening guard 21, track 35 and shell 13 together. However, fasteners 23*a* and 23*e* are not absolutely necessary, and may be eliminated in order to reduce weight at the front of helmet 11. Alternatively, any number or arrangement of fasteners could be used to fasten guard 21, tracks 17 and 35,** and shell 13 together. The spacing between guard 21 and shell 13 provided by tracks 17 and 35 allows visor 15 to be placed under the guard to protect the visor from scratches and other damage when helmet 11 is not being worn or the visor is not needed. Visor guard 21 is provided with a slot 25 through which visor lock 27 can slide. Lock 27 projects through slot 25 and is fixedly mounted on visor 15 near its top. Lock 27 can be turned, and thereby tightened or loosened against guard 21 to respectively set visor 15 in position or release it. Lock 27 can be configured to be readily turnable by an aircrewman wearing gloves and helmet 11. Visor track 17 has a groove 43, in which the corresponding side edge of visor 15 is configured to seat and slide; the same is true of visor track 35.

Visor lock 27, groove 43 and the groove in track 35 serve to position visor 15 in helmet 11. The position of visor 15 in helmet 11 can be adjusted and set by turning visor lock 27 to loosen it (if necessary), moving the lock in slot 25, thus moving visor 15 along with the lock, until the visor is positioned as desired, and then turning the lock (in the opposite direction) to set the visor in position. The position of slot 25 is offset from center to shift the position of lock 27 and thus lower the overall profile of helmet 11, thereby increasing the head maneuverability and field of view of an aircrewman wearing the helmet.

As shown in FIGS. 2 and 3, material has been removed in the forward area of the crown region of shell 13 beneath guard 21 by drilling or otherwise providing the shell with a plurality of holes 33. Such removal of material in the forward part of helmet 11 results in substantially lessened weight in that area, resulting in relocation of the center of gravity of the helmet rearward and downward which is critical to helmet stability during acceleration such as would appear during air combat maneuvers. Such relocation of the center of gravity is especially important in that the tendency of helmet 11 to rotate forwardly against the wearer's face under head-to-seat acceleration is substantially reduced or eliminated. Furthermore, comfort of the wearer is improved in that helmet 11 is no longer "front/top heavy" because of the change of the center of gravity of the helmet, and in that the total weight of the helmet has been reduced.

In order to maintain the structural integrity of shell 13, holes 33 are offset and spaced with respect to each other. In addition, any impact to the forward area of helmet 11 must first be absorbed by guard 21 and tracks 17 and 35, before reaching the portion of shell 13 provided with holes 33. Thus, installation of holes 33 accomplishes helmet 11 weight reduction in an area critical to the relocation of the center of gravity while maintaining an acceptable level of impact protection.

Figure 4:
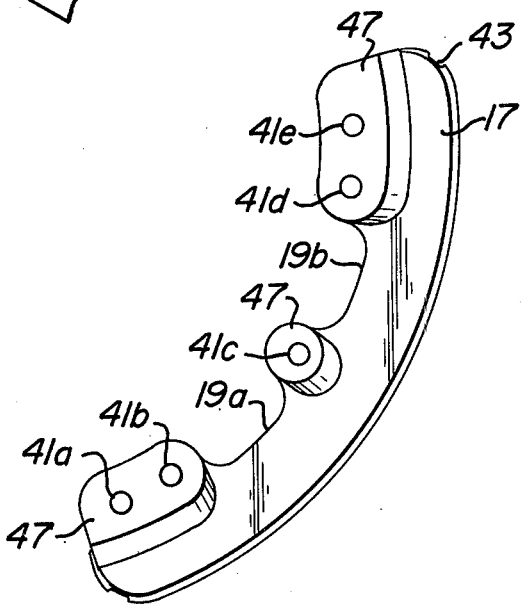
FIG. 4 shows in greater detail the visor track shown in FIG. 3.

In addition, material has been removed from track 17 to form one or more apertures 19, and track 35 is similarly apertured. The removal of material in the forward part of helmet 11 resulting from such aperturing results in lessened weight in that area and thus in movement of the center of gravity of the helmet aft and downward, as was the case with holes 33, and with similar advantages. FIG. 4 shows a reversed view of track 17, showing a preferred construction thereof with material removed from one side and from the bottom surface which fits the outer surface of the shell 13. For proper fit of track 17 in helmet 11, top surface 45 (except for that portion which visor 15 must pass over to reach groove 43) should be configured to conform to the inside surface of guard 21 and bottom surface 47 should be developed to match the outside surface of shell 13. As shown in FIG. 4, while track 17 is substantially apertured, sufficient material has been left therein so that the track is capable of supporting guard 21 on shell 13. Track 17 has further been provided with a plurality of holes 41 to accommodate fasteners 23. Since only one hole 41 is needed for each fastener 23, the number of holes 41 can be the same as the number of fasteners 23 used, whatever that number might be. It should be understood that the configuration of track 35 corresponds to that of track 17 and that what has been stated heretofore with regard to track 17 also applies to track 35.

The removal of material in shell 13 and in tracks 17 and 35 promotes air flow and relieves aerodynamic pressures, as shown in FIG. 3. Apertures 19 in track 17 and the apertures in track 35 allow air, which would normally be trapped under visor 15 by windblast during ejection to escape from under the visor, thereby relieving dynamic pressure buildup and preventing fracture. Similar dynamic air pressure under shell 13 is also relieved. Slot 25, and apertures 29 and 31 in the rear of guard 21, also help relieve aerodynamic pressure and promote air flow under guard 21, but apertures 19 and the apertures in track 35 are especially important because of their proximity to visor 15, which is more likely to fracture under pressure than is guard 21. Holes 33 in shell 13 permit the flow of air from under the shell, thereby relieving dynamic air pressure inside the helmet shell and subsequent lift forces thereon during ejection windblast. Furthermore, apertures 19 in track 17 and the apertures in track 35 promote air flow and circulation under visor 15 for cooling, ventilation and sweat evaporation, and improve air circulation under shell 13. Holes 33 promote air flow under shell 13, thus increasing ventilation and cooling to the pilot's head. Apertures 19, the apertures in track 35, and holes 33 promote air flow under shell 13, and thus, when used in conjunction with a cloth hat suspension 39, increase sweat evaporation from the suspension and optimize cooling of the wearer's head.

It should be understood that this invention is not limited to use as an aviator's helmet. Helmet 11 is also usable as a safety helmet for general applications, and can be used by miners, racing car drivers, and others. Also, other devices than visor lock 27 can be used to releasably set visor 15 in the position desired. In addition, a slot 25 can be placed on the left or right side of the helmet, without increasing the helmet 11 profile. A centered slot 25 can also be utilized, but with the result that the helmet 11 profile would be raised. Furthermore, suitable materials other than those already mentioned can be used in the construction of the helmet.

Thus there has been provided a novel ventilated helmet with selected weight distribution. In this helmet, the center of gravity has been moved rearward and downward to increase helmet stability, and to prevent forward rotation of the helmet against the wearer's face under head-to-seat acceleration. Foward rotation of the helmet due to deceleration or braking, such as is experienced by a racing car driver, or by an aircrewman in an aircraft which is landing, is also prevented thereby. The wearer's comfort is also improved in that the helmet is no longer "front/top heavy" because of the change of the center of gravity of the helmet, and in that the total weight of the helmet has been reduced. Furthermore, the flow of air through the helmet has been facilitated, so that, during ejection, dynamic air pressures in the helmet (particularly under the visor) are relieved. As a result, fracture of the helmet visor, causing the visor to be either blown off or forced into the pilot's face, is prevented. Also, lift forces imparted to the pilot's head, resulting from dynamic air pressure inside the helmet shell and the visor guard, are prevented. In addition, ventilation and cooling of the wearer's head is increased by promoting air flow inside the helmet, without any power requirements. This air flow also increases the cooling capabilities of a cloth hat suspension where used. All this is accomplished while maintaining the structural integrity of the helmet, and an acceptable level of impact protection.

Obviously, many modifications and variations of the present invention are possible in light of the above teachings. It is therefore to be understood that within the scope of the appended claims the invention may be practiced otherwise than as specifically described.

What is claimed is:

1. A helmet comprising:

a helmet shell having a plurality of holes in the frontal region thereof;

first and second spacing means mounted on either side of the front of said helmet shell, each of said spacing means being provided with at least one aperture for permitting the flow of air therethrough;

a visor guard mounted on said first and second spacing means and covering said plurality of holes; and a visor located at the front of said helmet and mounted on said first and second spacing means.

2. A helmet as defined in claim 1 further comprising: a cloth hat suspension disposed inside said helmet shell.

3. A helmet as defined in claim 1 wherein said first and second spacing means comprise a pair of visor tracks.

4. A helmet as defined in claim 3 wherein said visor tracks are arcuate.

5. A helmet as defined in claim 1 wherein said helmet shell has in the frontal region thereof a plurality of holes offset and spaced with respect to each other.

6. A helmet comprising:

a helmet shell having a plurality of holes restricted to within the forward area of the crown region thereof;

a pair of visor tracks mounted on said helmet shell on either side of said forward area;

a visor guard mounted on said helmet shell in fixed relation thereto and covering said plurality of holes; and a visor located at the front of said helmet and slidably mounted on said visor tracks.

7. A helmet as defined in claim 6 further comprising: a cloth hat suspension disposed inside said helmet shell.

8. A helmet as defined in claim 6 wherein said helmet shell has in the frontal region thereof a plurality of holes offset and spaced with respect to each other.

9. A helmet comprising:

a helmet shell;

a pair of visor tracks mounted on either side of the front of said helmet shell, each of said tracks being provided with at least one aperture permitting flow of air therethrough; and a visor located at the front of said helmet and mounted on said visor tracks.

10. A helmet as defined in claim 9 further comprising: a cloth hat suspension disposed inside said helmet shell.

11. A helmet comprising:

a helmet shell having a plurality of holes in the frontal region thereof;

first and second spacing means mounted on either side of the front of said helmet shell, each of said spacing means being provided with at least one aperture for permitting the flow of air therethrough;

a visor guard fixedly mounted on said first and second spacing means and covering said plurality of holes, and having a slot aligned parallel to said first and second spacing means and intermediate the ends of said visor guard;

a visor configured to be insertable between said visor guard and said helmet shell slidably mounted on said first and second spacing means between a retracted position between said visor guard and said helmet shell, and an extended position below said visor guard; and locking means, slidable in said slot and fixedly mounted to said visor, for locking said visor in the position desired.

12. A helmet as defined in claim 11 further comprising: a cloth hat suspension disposed inside said helmet shell.

13. A helmet as defined in claim 11 wherein said helmet has in the frontal region thereof a plurality of holes offset and spaced with respect to each other.

14. A helmet as defined in claim 11 wherein said first and second spacing means comprise a pair of visor tracks.

15. A helmet as defined in claim 14 wherein said visor tracks are arcuate.

* * * * *